US009585469B2

(12) United States Patent
Huang

(10) Patent No.: US 9,585,469 B2
(45) Date of Patent: Mar. 7, 2017

(54) COMBINATION MULTI-LEVEL RACK

(71) Applicant: Steve Huang, Taichung (TW)

(72) Inventor: Steve Huang, Taichung (TW)

( * ) Notice: Subject to any disclaimer, the term of this patent is extended or adjusted under 35 U.S.C. 154(b) by 0 days.

(21) Appl. No.: 14/697,019

(22) Filed: Apr. 27, 2015

(65) Prior Publication Data

US 2016/0120311 A1 May 5, 2016

(30) Foreign Application Priority Data

Oct. 29, 2014 (TW) ..... 103219159 U

(51) Int. Cl.
*A47B 47/02* (2006.01)

(52) U.S. Cl.
CPC ..... *A47B 47/021* (2013.01)

(58) Field of Classification Search
CPC ..... A47B 55/02; A47B 47/021; F16B 7/044; F16B 7/048
USPC ..... 211/182, 186
See application file for complete search history.

(56) References Cited

U.S. PATENT DOCUMENTS 2,879,087 A * 3/1959 Haglund ..... E04G 7/14 211/182
2,894,643 A * 7/1959 Maslow ..... A47B 55/02 211/182
2,913,128 A * 11/1959 Milner ..... A47B 55/02 108/181
2,919,816 A * 1/1960 Maslow ..... A47B 55/02 108/181
2,970,702 A * 2/1961 Maslow ..... A47B 55/02 108/106
3,138,123 A * 6/1964 Maslow ..... A47B 55/02 108/159
3,208,406 A * 9/1965 Maslow ..... A47B 55/02 108/158.11
4,778,066 A * 10/1988 Stjernberg ..... A47B 57/12 211/181.1
5,027,959 A * 7/1991 Luukkonen ..... A47B 57/36 211/181.1
5,065,873 A * 11/1991 Tseng ..... A47B 57/54 108/107
5,221,014 A * 6/1993 Welch ..... A47F 5/13 211/181.1
5,326,062 A * 7/1994 Remmers ..... F16B 12/42 211/106
5,833,084 A * 11/1998 Chang ..... A47B 55/02 108/107
6,079,575 A * 6/2000 Wang ..... A47B 57/265 108/110

(Continued)

*Primary Examiner* — Stanton L Krycinski
(74) *Attorney, Agent, or Firm* — WPAT, P.C., Intellectual Property Attorneys; Anthony King

(57) ABSTRACT

A combination multi-level rack includes two side racks, at least an object holding member, and a fastener. Two sides of each of the side racks are provided with a longitudinal part, respectively, and a transverse part combined with the longitudinal parts. Four corners of the holding member are provided with a combining member, respectively. Each of the combining members has an engaging groove and a combining part disposed on a lateral side of the engaging groove, and the engaging groove engages the transverse part. The fastener removably engages the combining part with the longitudinal part. Therefore, the object holding member is stably combined to the two side racks.

4 Claims, 10 Drawing Sheets

(56) References Cited

U.S. PATENT DOCUMENTS

| | | | | |
|---|---|---|---|---|
| 6,119,881 | A * | 9/2000 | Yang | A47B 55/02 108/147.13 |
| 8,651,300 | B2 * | 2/2014 | Chen | A47B 47/024 108/107 |
| 2001/0006163 | A1 * | 7/2001 | Scudeller | A46B 17/02 211/182 |
| 2012/0298606 | A1 * | 11/2012 | Chen | 211/186 |

* cited by examiner

COMBINATION MULTI-LEVEL RACK

BACKGROUND OF THE INVENTION

1. Field of the Invention

The present invention relates to combination multi-level racks, and more particularly, to a combination multi-level rack easy for adjusting the height for objects storing.

2. Description of the Related Art

A conventional multi-level rack has plural levels of space longitudinally disposed for placing or storing objects. Such racks are often provided in indoor at working places.

Referring to FIG. 1 and FIG. 2 illustrating the perspective view and exploded view of a conventional multi-level rack, a multi-level rack 1 comprises a couple of side racks 2 and at least a board 3, wherein the four corners of the board 3 are provided with a coupler 4 disposed through a self-tapping screw 8, respectively, so as to provide a supporting effect. Therein, two sides of each side rack 2 are provided with two vertical rods 5, respectively, with one horizontal rod 6 transversely welded between the two sides of the side rack 2; also, the horizontal rod 6 defines an interval between the two corresponding vertical rods 5. The coupler 4 is provided with a U groove 7 for being engaged between the two vertical rods 5 on the upper edge of the horizontal rod 6. In addition, the coupler 4 slightly opens a gap between the two vertical rods 5 on two sides of the side racks 2, so as to fix the board 3 on the two side racks 2.

However, when the multi-level rack is being assembled, the coupler 4 is needed to be coupled between the two vertical rods 5 first, and the board 3 is subsequently in aligned and fastened with the coupler 4. When the process is accomplished, the side rack 2 is slightly opened by the board 3 to achieve a lateral fixing status, whereby the height of the board 3, especially disposed on the multi-level rack 1, is not allowed to be adjusted for meeting different user demand. Moreover, if the height of the board 3 is to be adjusted, the coupler 4 needs to be separated with the board 3. After repeated disassembling and reassembling process, screw hole of the board 3 is unavoidably expanded to impose negative affect upon the combination strength of the components. Therefore, such multi-level rack 1 needs to be improved.

SUMMARY OF THE INVENTION

For improving aforementioned issues, the present invention discloses a combination multi-level rack, wherein an object holding member is longitudinally combined to a transverse part of the side rack, with the lateral edge of the object holding member combined and fixed with the side rack, such that the height of the object holding member is allowed to be adjusted easily.

For achieving the objective above, the present invention provides a combination multi-level rack, comprising:

two side racks;

at least an object holding member; and a fastener.

Therein, two sides of each of the side racks are provided with a longitudinal part, respectively, and a transverse part combined with the longitudinal part. Four corners of the holding member are provided with a combining member, respectively, while each of the combining members has an engaging groove and a combining part disposed on a lateral side of the engaging groove. The engaging groove engages the transverse part. The fastener removably engages the combining part with the longitudinal part. Therefore, the object holding member is stably engaged with the two side racks.

With such configuration, when the height of the object holding member is to be adjusted, the user simply needs to loosen the fastener, such that the height of the object holding member is allowed to be adjusted, and the combining structure between the combining member and the object holding member is not affected.

For achieving the objective above, the present invention provides another embodiment of the multi-level rack, comprising:

at least three side racks, with two sides of each of the side racks provided with a longitudinal part, respectively, and a transverse part combined between the longitudinal parts;

at least two object holding members, with a combining member fixed on two opposite corners of the object holding member, respectively, for being engaged with the side rack on the outer side of the object holding member;

at least two connecting members, disposed between two neighboring corners of the two different object holding members for connecting the two object holding members, each of the connecting members having a positioning groove and a fixing portion disposed on the later side of the positioning groove, wherein the positioning groove engages the transverse part of the side rack between the two object holding members; and a fastener, removably engaging the combining part and the longitudinal part.

Therefore, the multi-level rack provided by the present invention is allowed to be transversely expanded with another multi-level rack, thereby expanding the levels and area of the object holding members.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Figure 1:
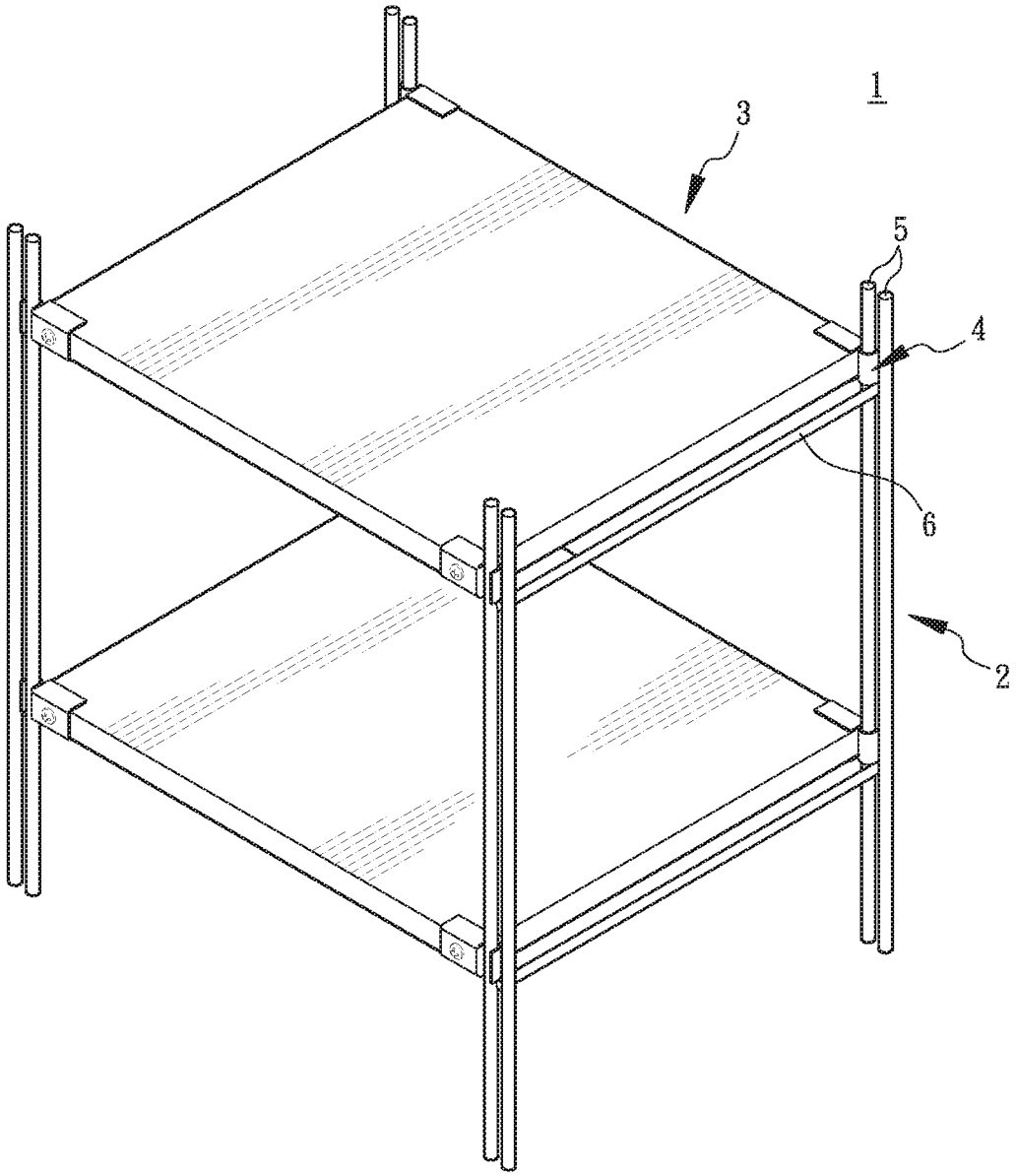
FIG. 1 (Prior Art)
FIG. 1 is a perspective view of a conventional multi-level rack.
Figure 2:
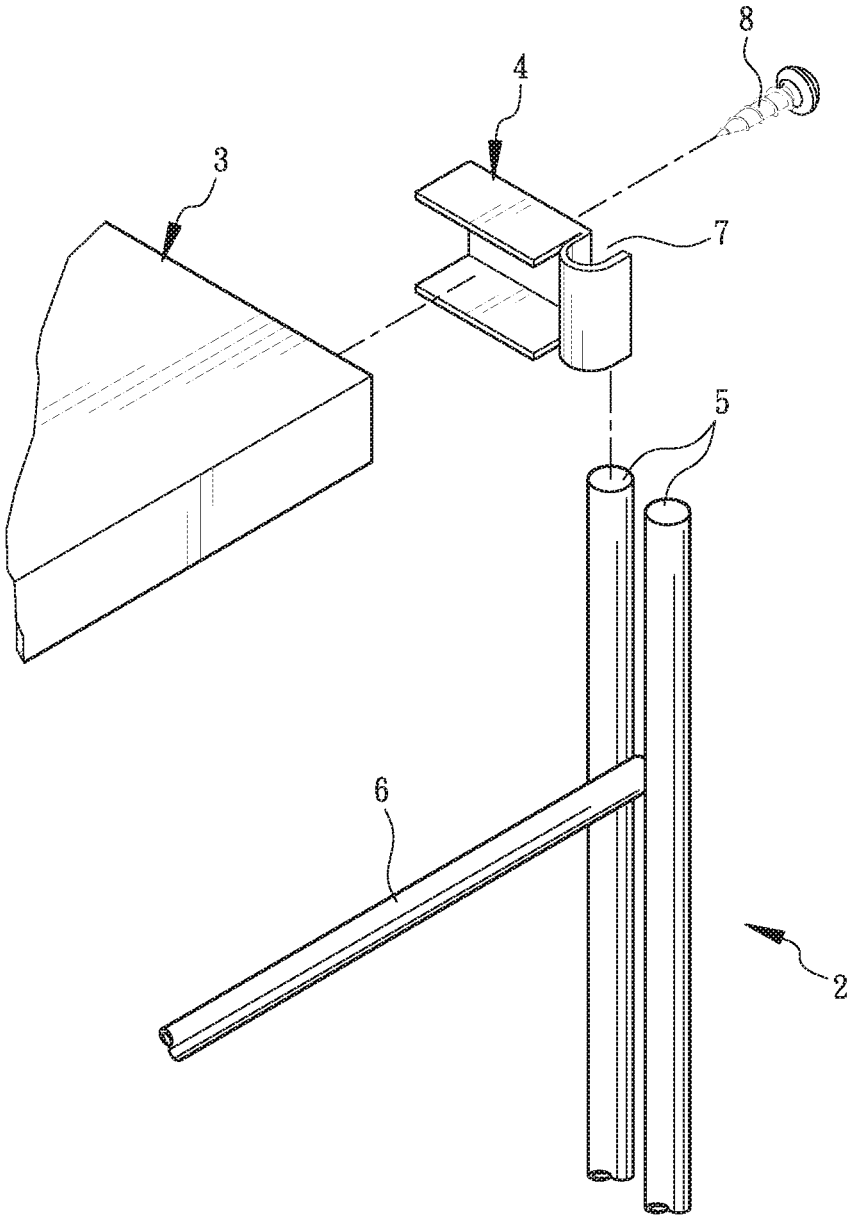
FIG. 2 (Prior Art)
FIG. 2 is an exploded view of the conventional multi-level rack in FIG. 1.
Figure 3:
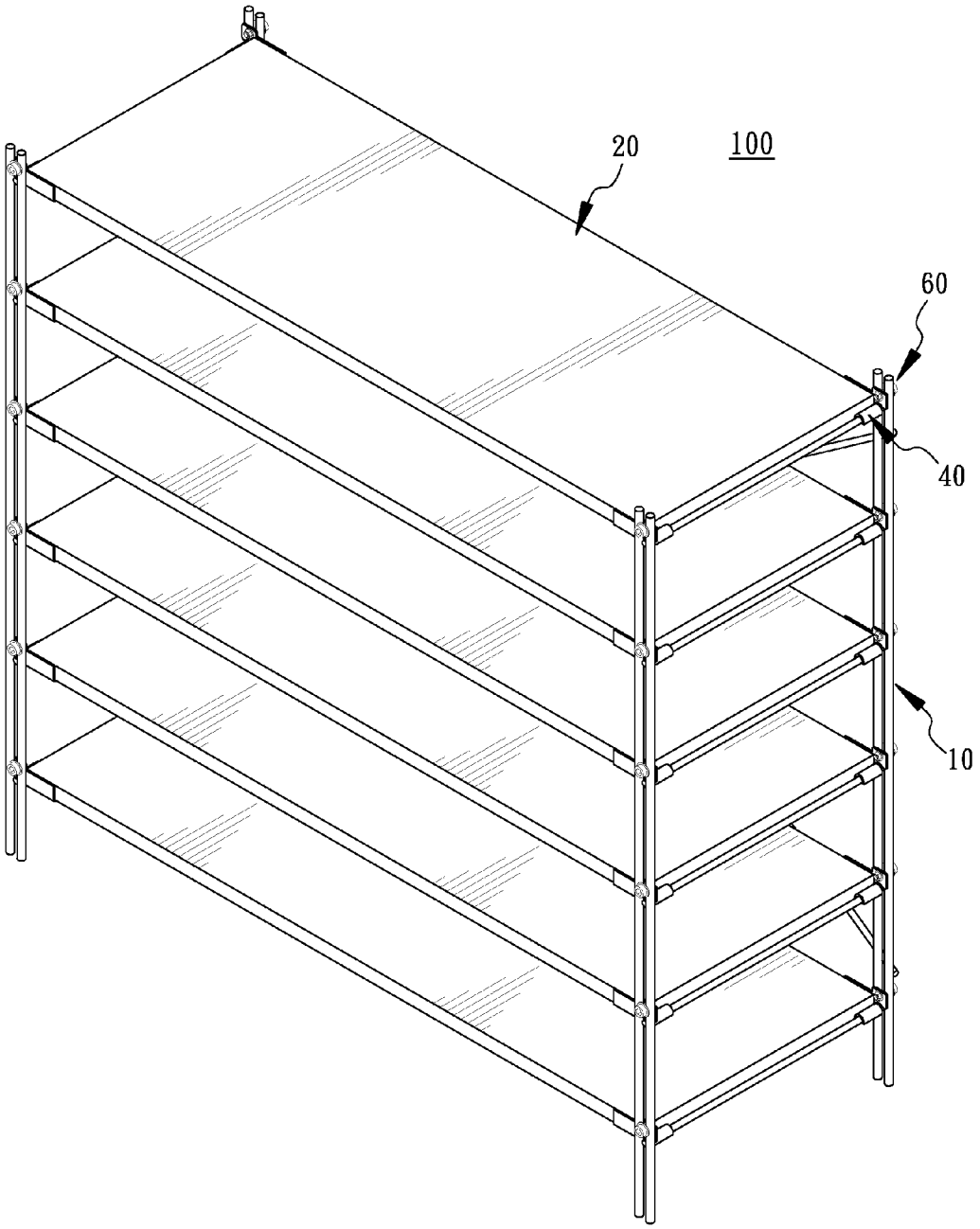
FIG. 3 is a perspective view of a combination multi-level rack in accordance with the present invention.
Figure 4:
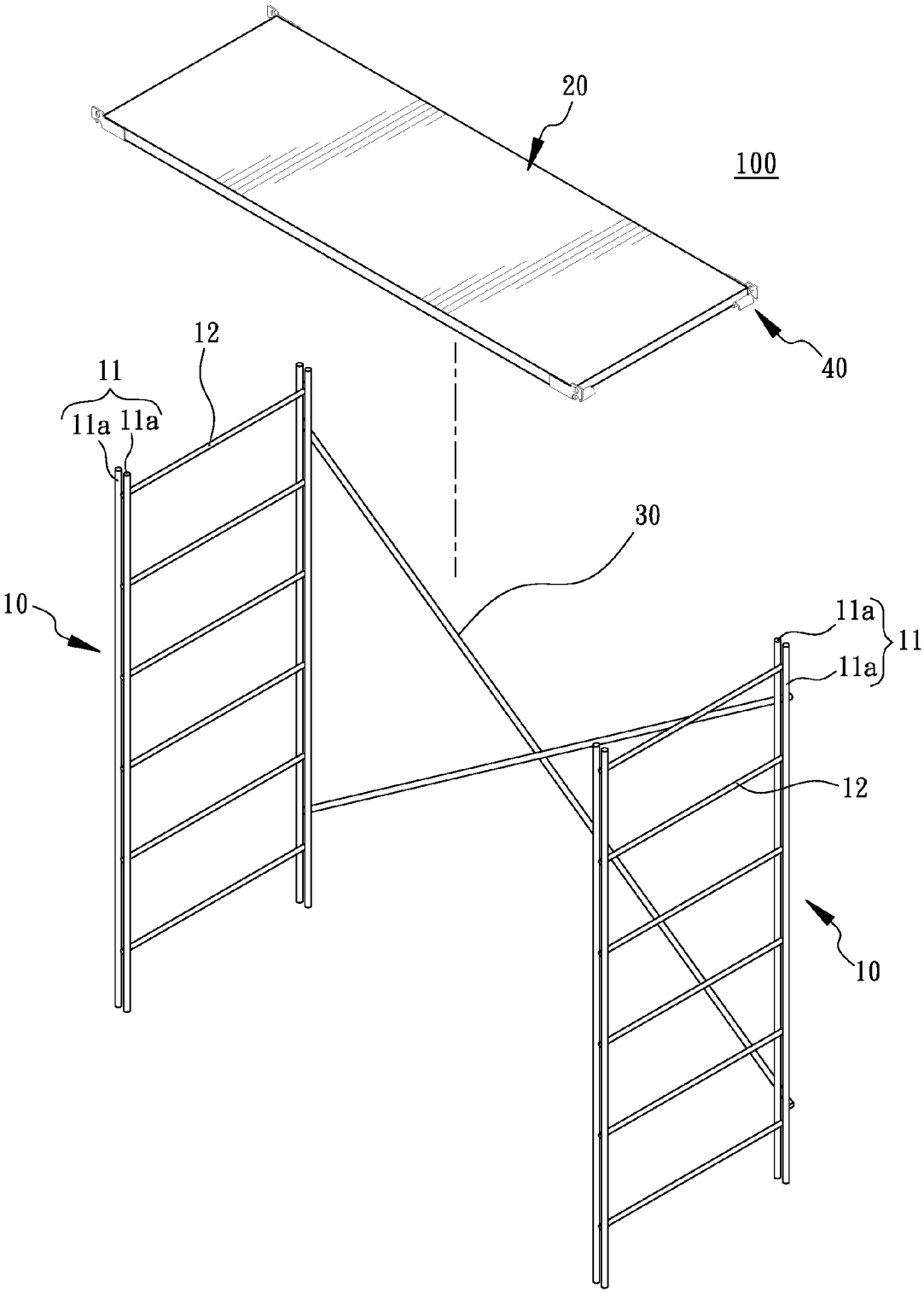
FIG. 4 is a schematic view illustrating the object holding member detached from the side rack.
Figure 5A:
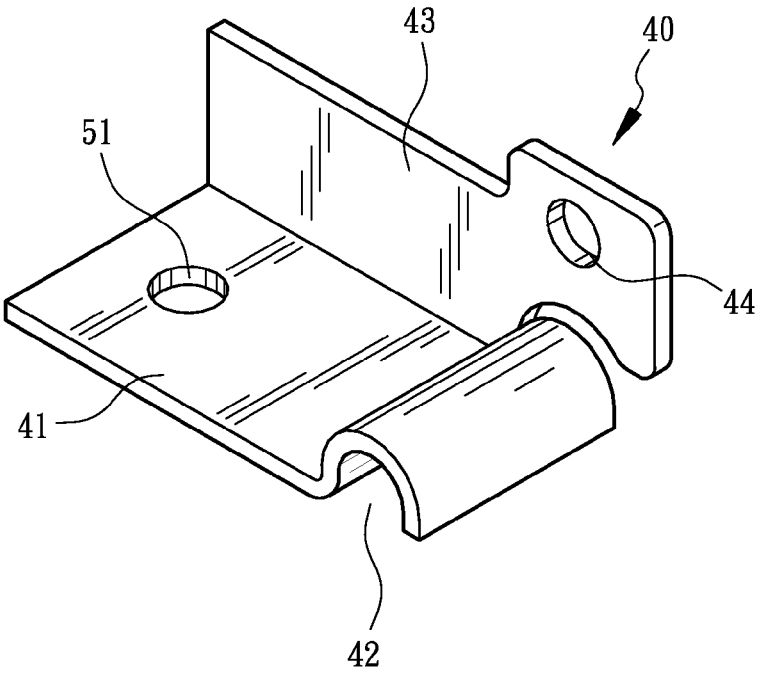
FIG. 5A is a perspective view of a combining member in accordance with the present invention.
Figure 5B:
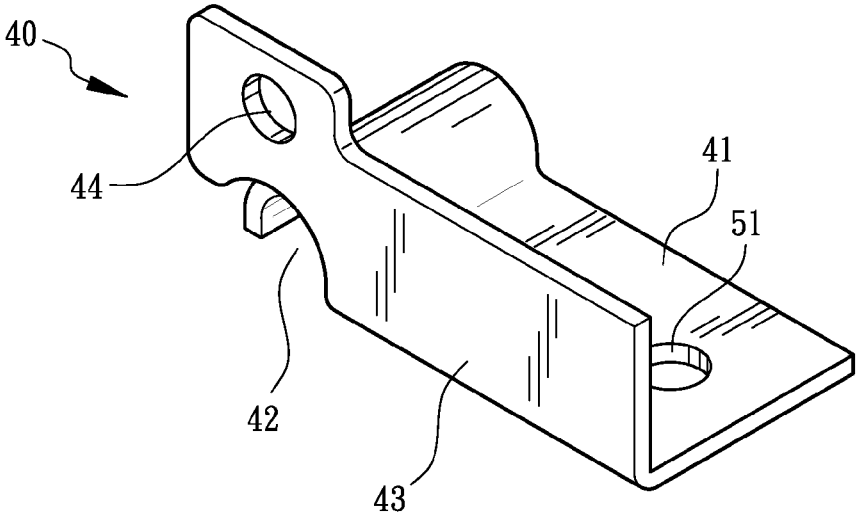
FIG. 5B is another perspective view of the combining member taken from another point of view in accordance with the present invention.

Referring to FIG. 3 to FIG. 8, the present invention provides a combination multi-level rack 100, comprising two side racks 10, at least an object holding member 20, and a cross rod member 30 fastened between the two side racks (as shown in FIG. 4), such that the combination multi-level rack 100 is provided with stronger structural stability.

The side rack 10 has the two sides thereof provided with a longitudinal part 11, respectively, with at least a transverse part 12 combined between the two longitudinal parts 11. In the embodiment provided by the present invention, the longitudinal part 11 is formed of two vertically disposed rod members 11*a*, and the transverse part 12 is also a rod and welded between the two rod members 11*a*, so as to interspace the two rod members 11*a*. The transverse part 12 is allowed to be provided in plurality on the side rack 10 with an interval between each two of the transverse parts 12.

The object holding member 20, which is in a board shape in the embodiment provided by the present invention, is allowed to be provided in a drawer form having a containing space. Therein, the amount of the object holding member 20 on each of the side racks 10 is allowed to be equal to the amount of the transverse parts 12.

Plural combining members 40 are fixed to four corners of the object holding member 20 by, for example, self-tapping screws 50, respectively; however, other methods such as welding are still applicable for fixing the combining members 40 to the object holding member 20. Therein, each of the combining members 40 on the two sides of the object holding member 20 are symmetrically disposed; in the drawings of the present invention, relative figures only show one side of the object holding member 20 for illustration. Each combining member 40 is integrally provided with a flat board 41, an engaging groove 42 disposed on one end of the flat board 41, and a combining part 43. The engaging groove 42 has an arc-shaped opening facing downward, so as to engage the transverse part 12 on the side rack 10. Also, the flat board 41 is further provided with a screw hole 51, such that the self-tapping screw 50 passes through the screw hole 51 to be mounted on the object holding member 20. The combining part 43 is vertically connected to the flat board 41 and has an inner face and an outer face in opposite to the inner face, wherein the outer face is resisted against an inner edge of the longitudinal parts. Preferably, the combining part 43 is provided with a through hole 44 passing through the inner face and the outer face of the combining part and is at the same time arranged in alignment with the engaging groove 42.

A fastener 60 fastens the combining part 43 with the longitudinal part 11. Therein, the fastener 60 comprises a screw member 61 and a nut 62, wherein the screw member 61 passes through the longitudinal part 11 and is screwedly mounted around by the nut 62. Particularly, the screw member 61 passes through the spacing between the two rod members 11*a* and the through hole 44, and subsequently screwedly mounted by the nut 62, whereby the object holding member 20 and the side rack 10 are stably positioned and combined.

Figure 6:
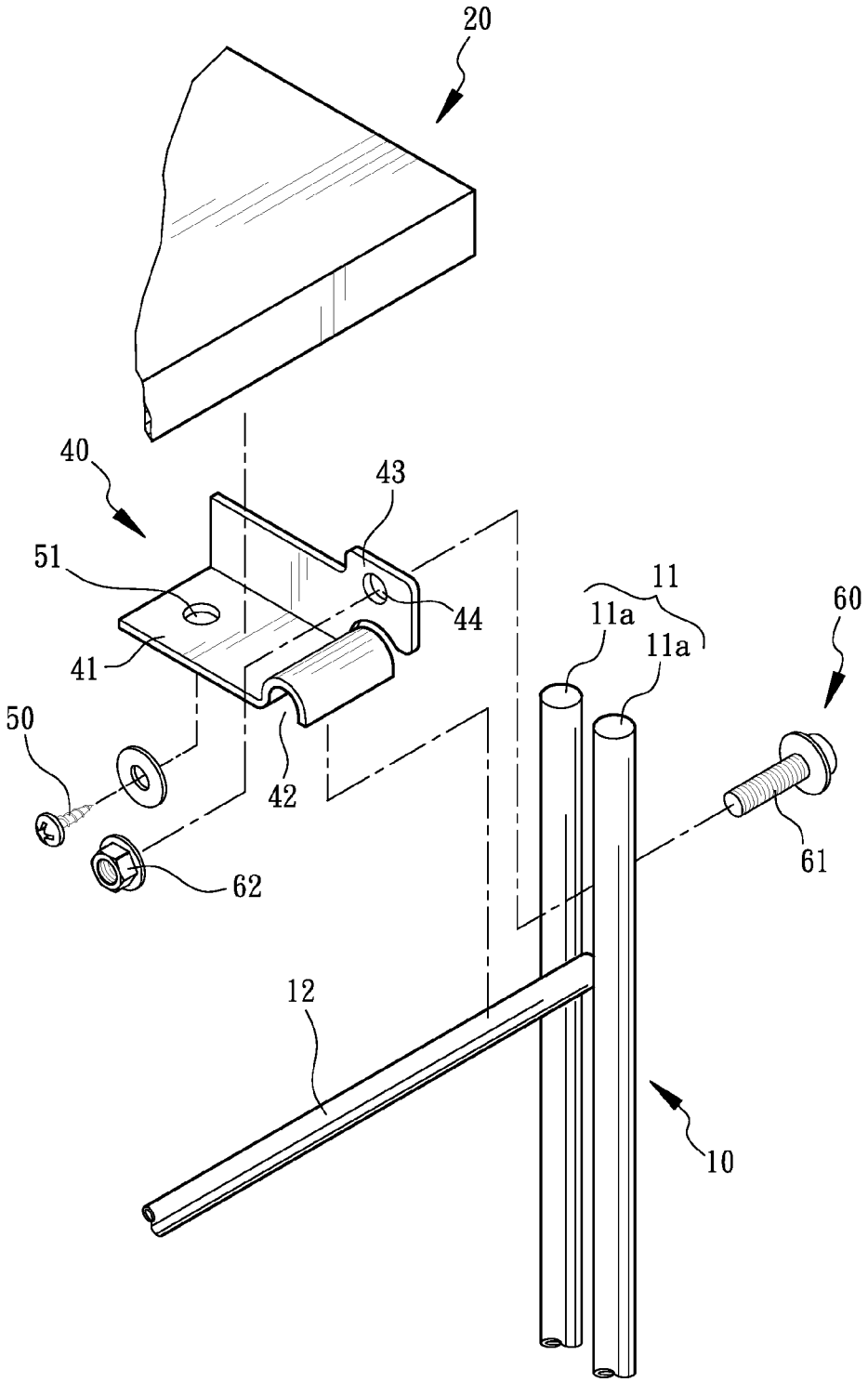
FIG. 6 is a partially exploded view of the structure of the combination multi-level rack in accordance with the present invention.

Referring to FIG. 6, when the combination multi-level rack 100 is being assembled, the plural combining members 40 are fastened on the four corners of the object holding member 20, and the user is allowed to subsequently place the object holding member 20 on the combination multi-level rack 100. In other words, the engaging groove 42 of each combining member 40 is combined to the transverse part 12. Afterward, the combining members 40 are fastened to the side racks 10 by use of the fasteners 60 to complete the combination multi-level rack 100. With such assembling steps, the object holding member 20 of the present invention is firstly combined with the combining members 40 and then placed on the side racks 10; next, the object holding member 20 is fastened with the side racks 10 by use of the fasteners 60. Therefore, when the height of the object holding member 20 needs to be adjusted, the user simply needs to loosen the screw member 61 against the nut 62, whereby the object holding member 20 is allowed to be easily detached for adjusting the height of the object holding member 20, such that the combining structure between the combining members and the object holding member 20 is not affected, facilitating the general adjusting process.

Figure 7:
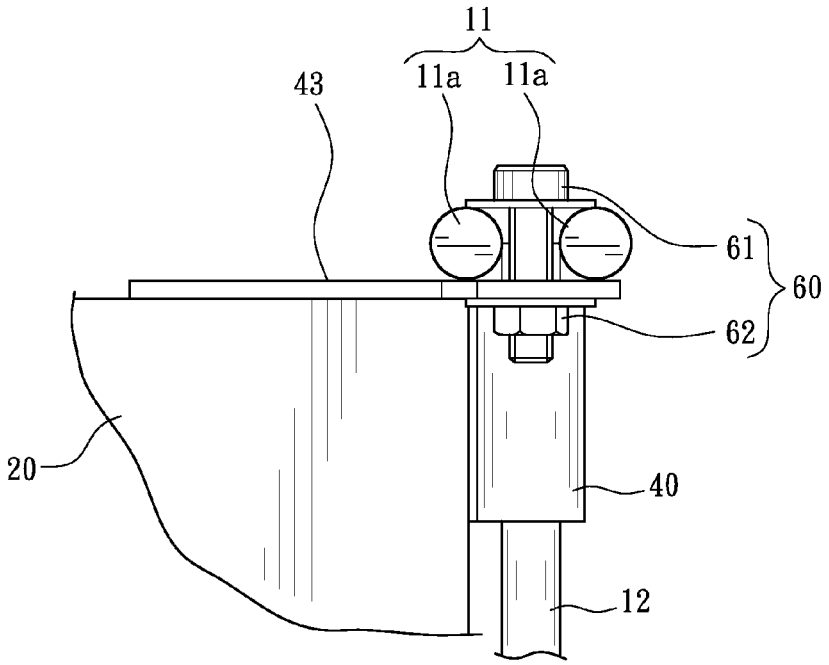
FIG. 7 is a partial schematic view illustrating the combining member engaged with the longitudinal part in accordance with the present invention.
Figure 8:
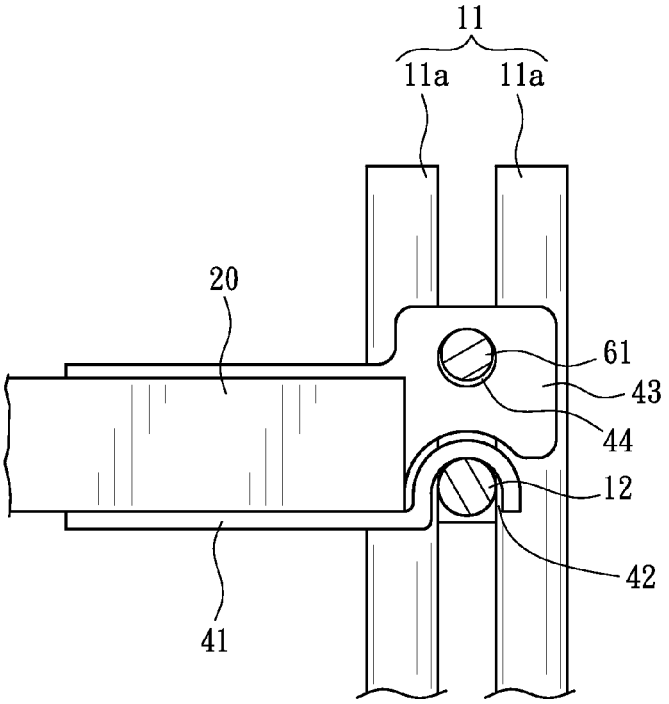
FIG. 8 is another partial schematic view illustrating the combining member engaged with the transverse part in accordance with the present invention.

Furthermore, referring to FIG. 7 and FIG. 8, the engaging grooves 42 of each combining member 40 in the present invention are disposed with the openings thereof facing downward for engaging the transverse part 12, wherein the object holding member 20 is longitudinally disposed on the side rack 10, and the combining member 40 is laterally fixed to the side racks 10 by use of the fasteners 60. As a result, the object holding member 20 is transversely fixed to the side racks 10 by the fasteners 60. Therefore, a stronger structural stability of the general combination multi-level rack 100 is provided, so as to achieve the objective for holding and bearing various kinds of objects thereupon.

Figure 9:
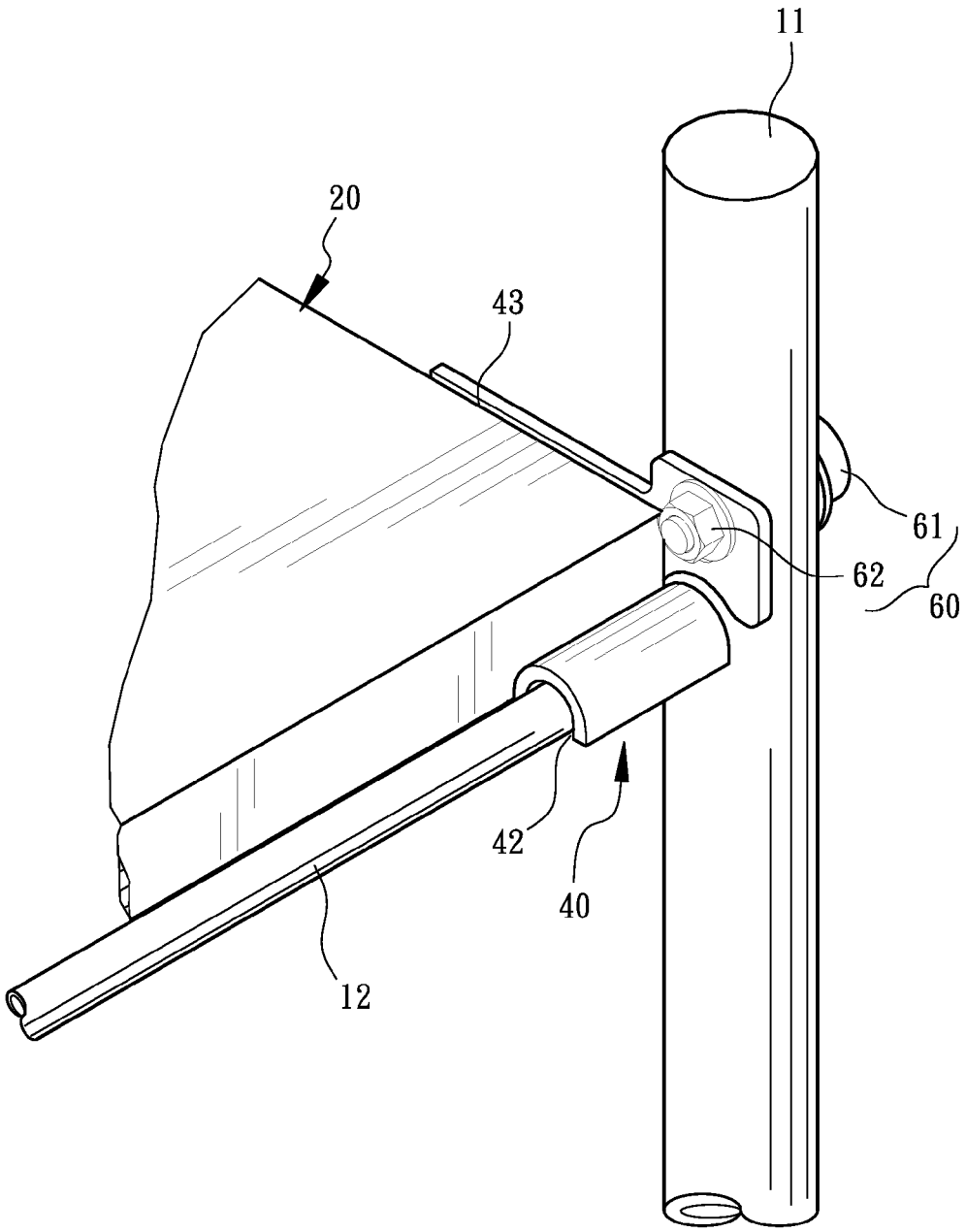
FIG. 9 is a partial perspective view of a second embodiment of the combination multi-level rack in accordance with the present invention.

Referring to FIG. 9 illustrating another embodiment of the present invention, the longitudinal part 11 of the side rack 10 of the present invention is provided in a form of a singular rod. Also, the singular rod is allowed to be a round tube or a non-round tube for achieving the desired function. Moreover, with different shapes of the singular rod, structure of the side racks 10 of the present invention is allowed to be freed from the limitation of a particular form. In addition, the longitudinal part 11 is able to be provided with a screw hole for substituting the nut 62 of the fastener 60, whereby the screw member 61 screws the combining member 40 to the longitudinal part 11 for achieving the combination.

Figure 10:
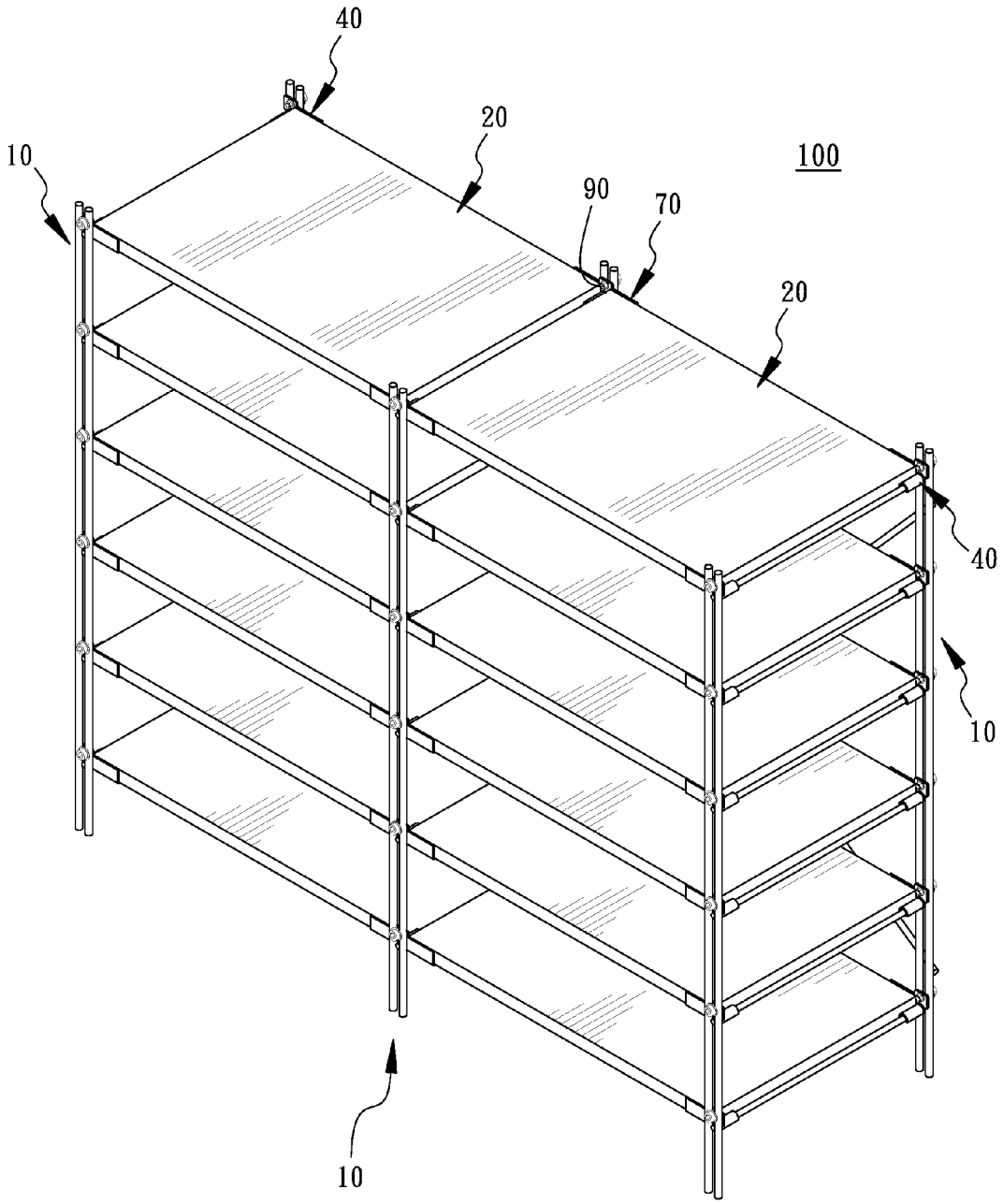
FIG. 10 is a perspective view of a third embodiment of the combination multi-level rack in accordance with the present invention.
Figure 11:
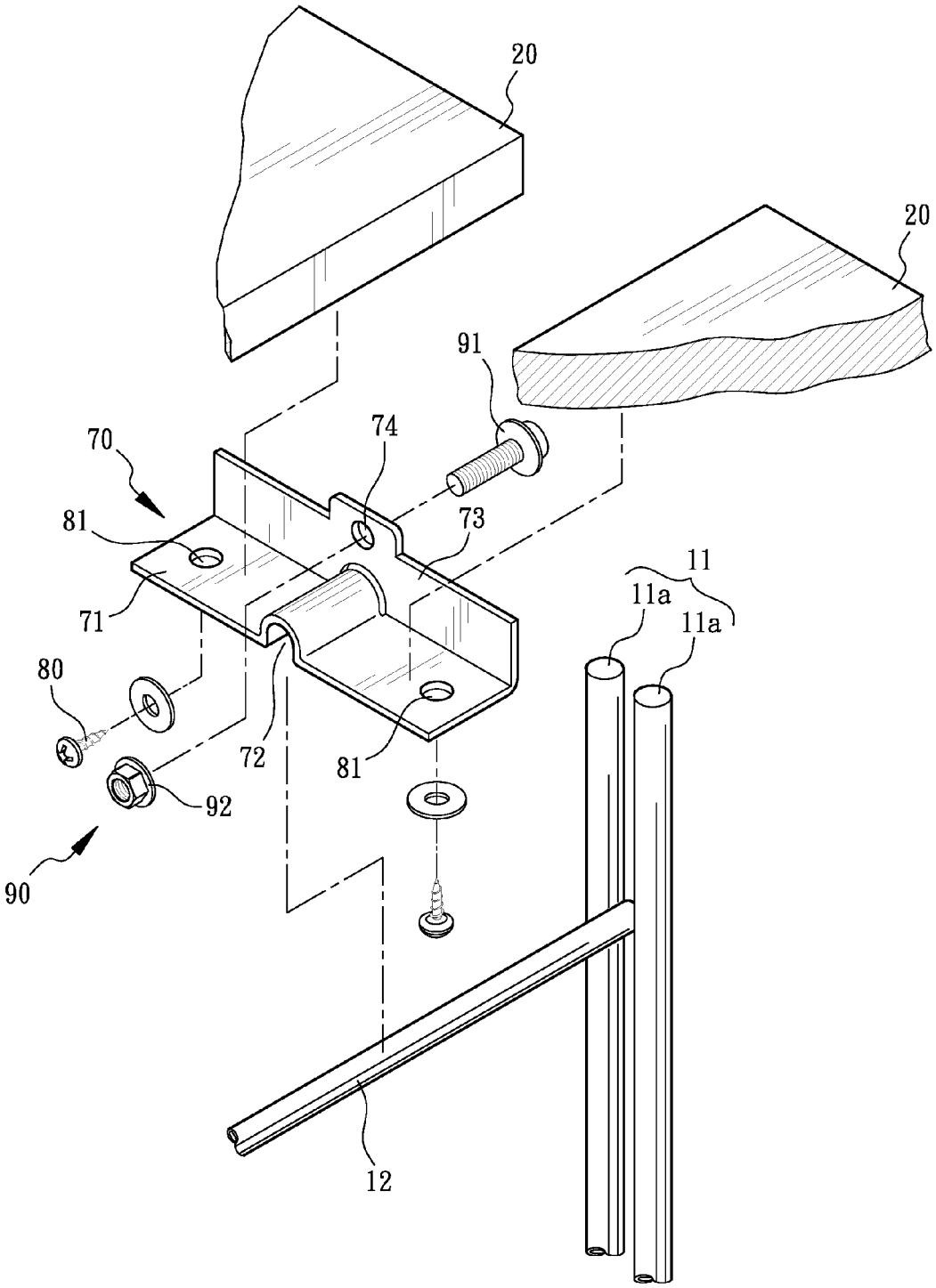
FIG. 11 is an exploded view of the third embodiment of the combination multi-level rack in FIG. 10.

Referring to FIG. 10 and FIG. 11 illustrating a third embodiment of the present invention, the combination multi-level rack 100 comprises at least three side racks 10, with the two side racks 10 disposed on the outer side and the one side rack 10 disposed on the inner side. Each of the side racks 10 is structurally identical as the aforementioned description; two sides of the side rack 10 are provided with a longitudinal part 11, respectively, with at least a transverse part 12 combined between the two longitudinal parts 11.

At least two object holding members 20 have a set of the combining members 40 disposed on two opposite corners thereof, respectively, for combining the side racks 10 disposed on the outer side. The combining members 40 here are structurally identical with the aforementioned description.

At least two connecting members 70 are disposed between the two neighbored corners of the two different object holding members 20 for connecting the two object holding members 20, and each connecting member 70 has a flat portion 71, wherein an arc-shaped positioning groove 72 facing downward is disposed in the middle of the flat portion 71 for engaging the transverse part 12 disposed on the inner side of the combination multi-level rack 100. One side of the flat portion 71 is vertically provided with a fixing portion 73, with a through hole 74 disposed on the fixing portion 73 and in vertical alignment with the positioning groove 72. In addition, two ends of the flat portion 71 are provided with a screw hole 81, respectively, for the self-tapping screws 80 to pass through and fasten the connecting member 70 to the two object holding members 20.

A fastener 90 fastens the fixing portion 73 to the longitudinal part 11. Therein, the fastener 90 is structurally identical with the aforementioned description, comprising a screw member 91 and a nut 92, and the screw member 91 passes through the longitudinal part 11 and the through hole 74 of the fixing portion 73 and subsequently screwedly mounted by the nut 92. With such configuration, the two connecting members 70 are combined to the two neighbored object holding members 20 and at the same time combined to the transverse part 12 on the inner side of the side rack 10. Also, with the fasteners 90 laterally fastening relative components, a stability of the general structure is achieved. Further, the combination multi-level rack 100 is allowed to be transversely expanded with another combination multi-level rack 100, thereby expanding the levels and square measure of the object holding members 20.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A combination multi-level rack, comprising:

at least three side racks, with two sides of each of the side racks provided with a longitudinal part, respectively, and a transverse part combined between the longitudinal parts;

at least two object holding members, with a combining member fixed on two opposite corners of each of the object holding members, respectively, for being engaged with the corresponding side racks on the outer side of the object holding members;

at least two connecting members, disposed between two neighboring corners respectively provided by the two object holding members for connecting the two object holding members, each of the connecting members having a positioning groove and a fixing portion disposed on a lateral side of the positioning groove, wherein the positioning groove engages the transverse part of one of the side racks between the two object holding members; and a fastener, removably engaging the fixing portion and the longitudinal part.

2. The combination multi-level rack of claim 1, wherein the connecting member is provided with a flat portion, and the positioning groove is disposed in the middle of the flat portion, and the fixing portion is vertically connected with the flat portion.

3. The combination multi-level rack of claim 1, wherein the fastener comprises a screw member and a nut with the screw member passing through the longitudinal part and the fixing portion, and the screw member is screwedly mounted by the nut.

4. The combination multi-level rack of claim 3, wherein the fixing portion is provided with a through hole which is in alignment with the positioning groove for the screw member to pass therethrough.

* * * * *